United States Patent [19]

Cabourne

[11] Patent Number: 4,806,104

[45] Date of Patent: Feb. 21, 1989

[54] HIGH DENSITY CONNECTOR

[75] Inventor: Michael K. Cabourne, Hacienda Heights, Calif.

[73] Assignee: ITT Corporation, New York, N.Y.

[21] Appl. No.: 154,163

[22] Filed: Feb. 9, 1988

[51] Int. Cl.[4] ..... H01R 9/09

[52] U.S. Cl. ..... 439/66; 439/591

[58] Field of Search ..... 439/66, 69, 591, 594

[56] References Cited

U.S. PATENT DOCUMENTS

| | | | |
|---|---|---|---|
| 2,884,613 | 4/1959 | Chandler et al. | 339/198 |
| 2,986,621 | 5/1961 | Midgley | 200/166 |
| 3,005,180 | 10/1961 | Dreher | 339/198 |
| 3,795,037 | 3/1974 | Luttmer | 439/591 |
| 3,954,317 | 5/1976 | Gilissen et al. | 439/66 |
| 4,634,199 | 1/1987 | Anhalt et al. | 339/17 M |
| 4,693,532 | 1/1987 | Colleran et al. | 439/594 |

FOREIGN PATENT DOCUMENTS

| | | |
|---|---|---|
| 1134588 | 4/1957 | France . |
| 2254126 | 7/1975 | France . |
| 164684 | 9/1958 | Sweden . |

*Primary Examiner*—Gil Weidenfeld
*Assistant Examiner*—P. Austin Bradley
*Attorney, Agent, or Firm*—Thomas L. Peterson

[57] ABSTRACT

A high density electrical connector is disclosed in which a stack of insulative strips are provided with multiple series of aligned contact cavities extending through the stack. The contacts for the connector have opposite ends which extend outside the opposite faces of the stack, and middle V-shaped resilient portions which cause the ends of the contacts to resiliently engage conductive pads on printed circuit boards mounted on opposite sides of the stack. The middle portion of each contact extends from the cavity in one strip into the cavity of the adjacent strip, so that the length of the middle portion can be increased, thereby enhancing the flexibility of the ends of the contacts.

17 Claims, 4 Drawing Sheets

HIGH DENSITY CONNECTOR

BACKGROUND OF THE INVENTION

The present invention relates generally to an electrical connector and, more particularly, to a high density, pressure contact type of electrical connector.

With an increasing input/output count for removable computer modules, the limits of present day pin and socket connector technology is being approached. The bulk associated with fitting a pin contact into the bore of a socket contact for mating connectors reaches practical limits in scale particularly where contact count extends into the thousands. One concept for extending total contact count and increasing density of the contacts in a connector is through the use of a "bed of nails" type of connector which is normally clamped between a pair of printed circuit boards, with the array of "nails" or contacts of the connector engaging a corresponding array of conductive pads on the two boards. Such "bed of nails" type of connectors which have been previously used have had the disadvantage that the contacts are straight and, therefore, have virtually no resilience that can accommodate for irregularities in the surface of the printed circuit boards engaged by the connector, and for connector manufacturing tolerances. Further, such prior art connectors have had problems in the precise spacial alignment and the positioning of the contacts therein.

U.S. Pat. No. 4,634,199 to Anhalt et al., assigned to the assignee of the present application, discloses a connector for making connections in a thin space between a pair of printed circuit boards. In contrast to a "bed of nails" type of connector in which there is an array of contacts distributed within a connector body, in the Anhalt et al. connector the contacts are arranged in two close straight rows and, therefore, are not suitable for making a multiplicity of electrical connections over a wide area as is required for use with computer modules having arrays of conductive pads thereon. The aforementioned Anhalt et al. patent discloses the use of contacts which are somewhat similar to those taught in the present application in that each contact has aligned, generally vertically extending contacting end portions, and a middle, generally V-shaped resilient portion, which allows the ends of the contacts to deflect inwardly against a resilient bias due to flexing of the V-shaped portion of the contact.

Connectors and relays are also known in the art which utilize a stack of insulators between which contacts are mounted. However, in such products, the contacts are not deflected axially, such as is desired for a "bed of nails" type of connector for clamping between a pair of printed circuit boards. Examples of connectors and relays of this type are disclosed in French Pat. Nos. 1,134,588 and 2,254,126 and Swedish Pat. No. 164,684.

It is the object of the present invention to provide a "bed of nails" type of electrical connector in which the contacts may be arranged in a high density with an arrangement which allows for increased contact flexure which will accommodate for irregularities in the printed circuit boards connected by the connector, and for connector manufacturing tolerances. Another object of the invention is to provide such a connector utilizing identical insulative strips which can be arranged and assembled to provide precise spacial alignment of the contacts, and staggering of the contacts which permits closer spacing of the contacts.

SUMMARY OF THE INVENTION

According to a principal aspect of the present invention, there is provided a high density, pressure contact type of electrical connector comprising a stack of insulators having at least one series of aligned cavities extending lengthwise through the stack. Contacts are mounted in certain of the cavities. Each contact has opposite ends which extend beyond the upper and lower surfaces of the stack of insulators, and are adapted to engage conductive pads on printed circuit boards mounted on one or both sides of the connector. Each contact also embodies a middle spring portion which extends from the cavity in which the contact is mounted into the next adjacent cavity in a series of cavities so that the middle portion of the contact occupies two cavities. By this arrangement, the length of the middle portion of the contact may be increased so that its flexure is enhanced, thereby permitting greater movement of the contacting ends of the contacts, so that irregularities in the surfaces of the boards and connector tolerances can be accommodated. This assures that all the contacts in the connector will make good electrical contact with the conductive pads on the printed circuit boards mounted against the connector.

According to another aspect of the invention, the insulators making up the stack are elongated, identical strips having interlocking means for precisely locating the strips and, thus, the contacts mounted therein. Adjacent strips are offset longitudinally relative to each other which permits the contacts in each strip to be mounted in rows staggered with respect to the rows of contacts in the adjacent strips. This arrangement permits precise spacial alignment of the contacts and a staggered arrangement of the contacts which permits the use of very thin insulative strips, thus allowing miniaturization of the connector.

Other objects, aspects and advantages of the invention will become apparent from the following description taken in connection with accompanying drawings.

DESCRIPTION OF THE PREFERRED EMBODIMENTS

Figure 1:
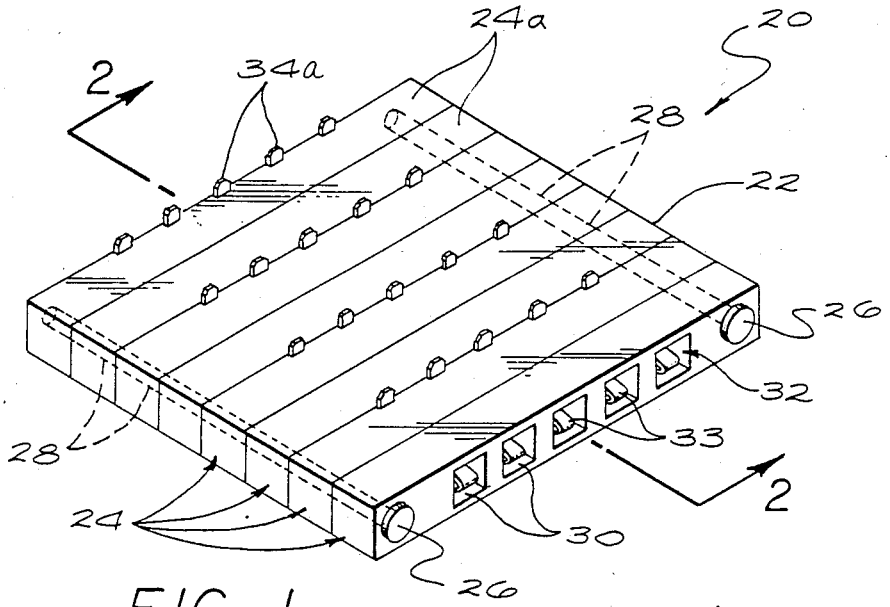
FIG. 1 is an isometric view of a simplified version of the connector of the present invention.
Figure 2:
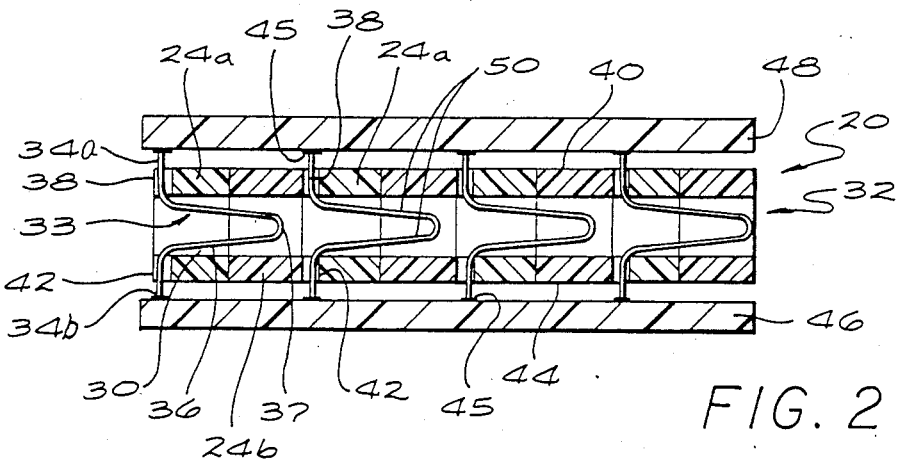
FIG. 2 is a vertical sectional view taken along line 2—2 of FIG. 1, with the connector shown mounted between a pair of printed circuit boards prior to clamping the parts together.
Figure 3:
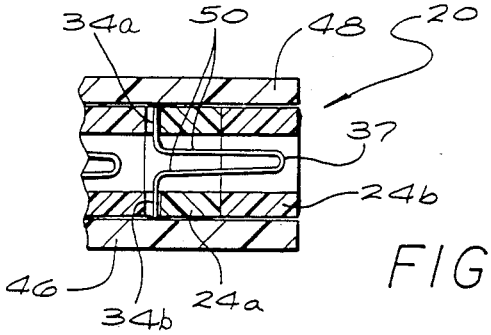
FIG. 3 is a fragmentary view showing one end of the assembly of FIG. 2, when the printed circuit boards have been clamped firmly against the upper and lower surfaces of the connector to actuate the contacts therein.

Reference is first made to FIGS. 1–3 of the drawings, which show a rather simplified form of the connector of the present invention, generally designated 20. The connector comprises a stack 22 of a plurality of elongated insulative strips 24 which are mounted in side-by-side relationship by a pair of alignment pins 26. Preferably the strips are formed of molded plastic. The pins extend through a series of aligned bores 28 formed in the opposite ends of the strips. Fasteners, not shown, are mounted on the ends of the pins to clamp the stack of insulative strips together. A row of contact cavities 30 is formed in each of the strips 24. The cavities in the adjcent strips are aligned to provide a plurality of series of cavities that extend transversely through the stack of strips, such series of cavities being designated by reference numeral 32. Contacts 33 are mounted in the cavities in alternate strips designated 24*a*.

Each contact has a pair of vertically aligned ends 34*a*, 34*b*, and a middle spring portion 36 which is generally V-shaped, forming an acute angle at the apex 37 of the middle portion of the spring. The upper end 34*a* of each contact extends upwardly through a slot 38 in the insulative strip 24*a* above the upper surface 40 of the stack 22 of strips. The lower end 34*b* of each contact extends downwardly through a slot 42 in the strip 24*a* below the lower surface 44 of the stack. The ends of the contacts are arranged to engage conductive pads 45 formed on the upper and lower surfaces, respectively, of printed circuit boards 46 and 48 mounted below and above the connector 20. As best seen in FIG. 1, the ends of the contacts are arranged in parallel rows along two axes to provide an array of contacts which engage a complementary array of conductive pads on the printed circuit boards.

As seen in FIGS. 2 and 3, the middle, V-shaped portions 36 of the contacts extend from the cavity 30 in the strip 24*a* into the cavity in the next adjacent strip 24*b* so that the middle portion of each contact occupies two aligned cavities. By this arrangement, the length of the middle portion of each contact may be relatively long, thereby increasing the flexure of the legs 50 of the middle portions of the contacts when the ends of the contacts are pressed inwardly toward the center of the cavities. Such increased flexure or flexibility of the legs of the contacts permits greater movement of the contact ends for accommodating irregularities in the surface of the boards 46 and 48 and connector tolerances in the vertical direction as viewed in FIG. 2.

The printed circuit boards illustrated in FIG. 2 are shown in a position before they have been pressed together to clamp the connector 20 therebetween. FIG. 3 shows the boards clamped against the upper and lower surfaces of the connector, causing the ends 34*a*, 34*b* of each contact to deflect inwardly flexing the legs 50 of the contact thereby reducing the angle of the legs at the apex 36 of the contact. Flexure of the middle portion of the contact produces a resilient force urging the ends of the contacts outwardly into engagement with the corresponding conductive pads 45 formed on the printed circuit boards.

Figure 5:
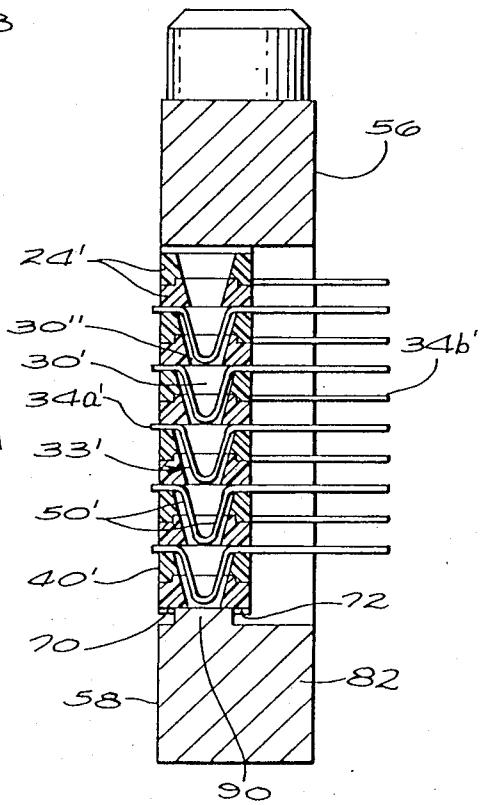
FIG. 5 is a sectional view taken along line 5—5 of FIG. 4.

Reference is now made to FIGS. 4–13 of the drawings, which illustrate a preferred embodiment of the connector of the present invention, in which the same reference numerals as used in FIGS. 1–3, differentiated by prime marks, are used to denote like or corresponding parts. In this embodiment, the connector 20′ is mounted in a rectangular frame 52, such two parts forming a generally flat connector assembly 54 which is adapted to be mounted between a pair of printed circuit boards, not shown, in a manner similar to that illustrated in FIGS. 2 and 3. The contacts 33′ are essentially identical to the contacts 33 used in the connector 20 except that one end portion 34*b*′ of each contact is in the form of an elongated post which extends below the bottom surface 56 of the frame 52 for mounting, and soldering, in plated-through holes in a printed circuit board that is mounted against the bottom of the frame. As in the first embodiment of the invention, the opposite end 34*a*′ of each contact extends above the upper surface 40′ of the connector for making pressure contact against pads on a printed circuit board mounted above the connector assembly 54. As best seen in FIG. 5, the upper surface 40′ is either coplaner with or slightly above the upper surface 58 of the frame 52 to assure that the printed circuit board mounted to engage the ends 34′ of the contacts will lie flush against the upper surface 40′ of the connector.

Figure 4:
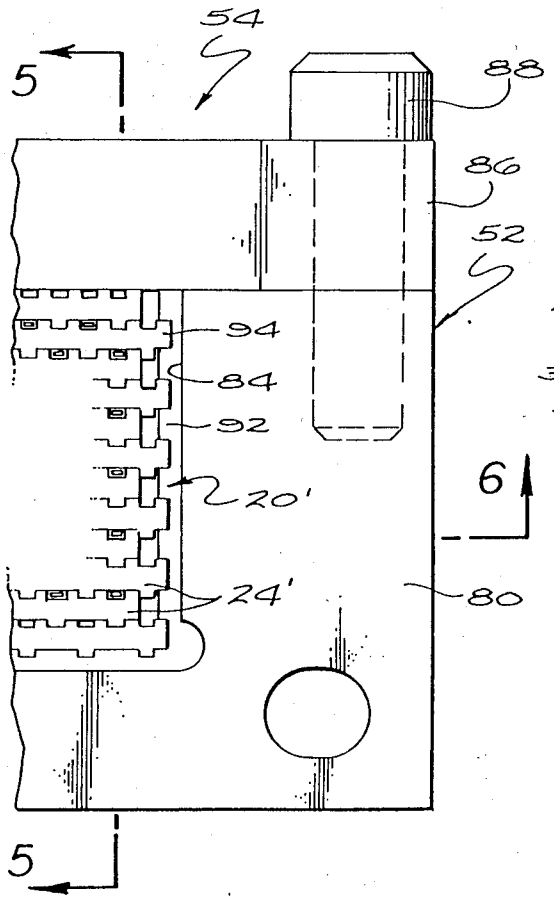
FIG. 4 is a top plan view of a preferred embodiment of a connector assmebly of the present invention, utilizing a connector made up of a plurality of insulative strips mounted in a frame.
Figure 4:
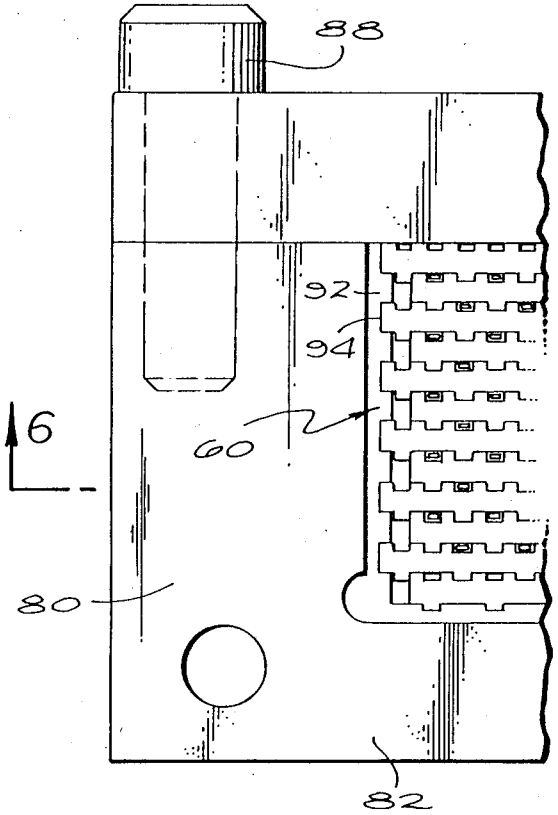
Figure 8:
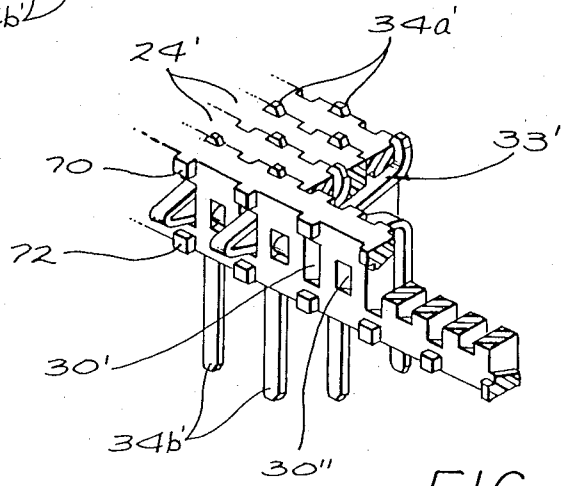
FIG. 8 is a fragmentary, isometric view of the connector utilized in the assembly illustrated in FIGS. 4–6, showing how the contacts are arranged in the insulative strips.
Figure 7:
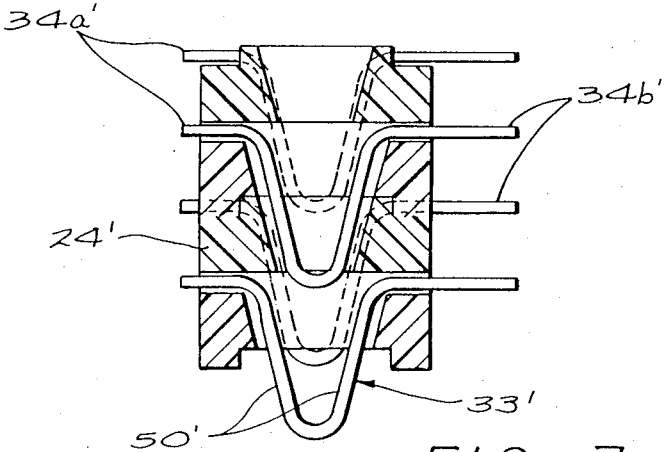
FIG. 7 is an enlarged, sectional view similar to FIG. 5 but showing only four of the insulative strips of the connector in cross-section, with the contacts in the alternate strips being shown in full lines and phantom lines, respectively.
Figure 10:
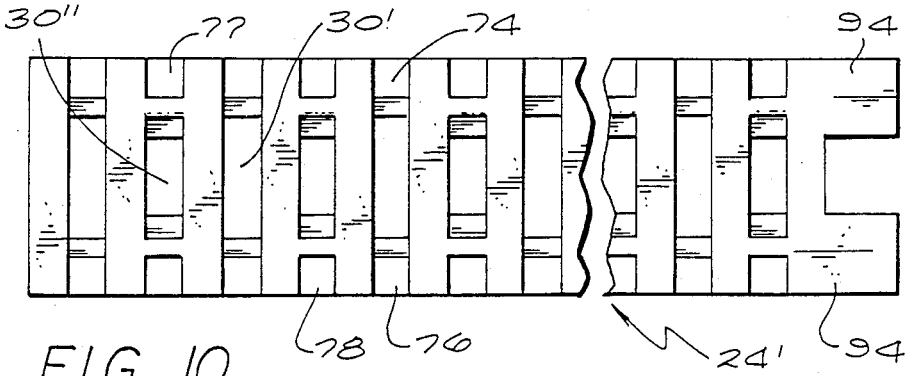
FIG. 10 is an enlarged, fragmentary side view of one side of the strip illustrated in FIG. 9.
Figure 9:
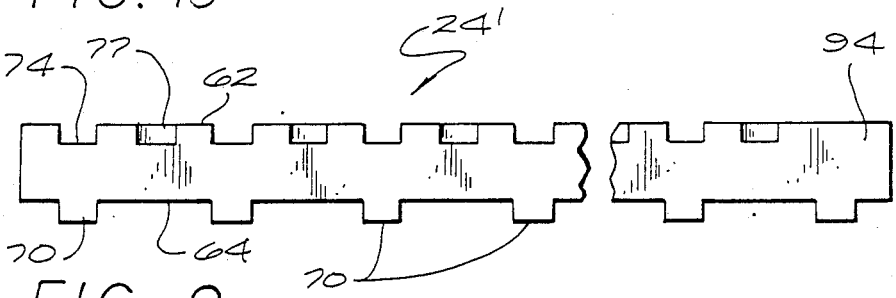
FIG. 9 is an enlarged, fragmentary top plan view of one of the strips used in the connector of FIGS. 4–8.

As best seen FIGS. 4 and 8, the elongated insulative strips 24′, which form the insulator assembly 60 of the connector, are specially designed to provide interlocking tongues and grooves, that assure a precise positioning of the strips relative to each other and, therefore, precise spacial alignment of the contacts, Further, alternate strips are offset lengthwise relative to each other so that the contacts in the cavities 30′ in the strips will be positioned in a staggered array. The staggered arrangement of the contacts allows the use of thinner insulative strips 24′, which thus permits a closer positioning of the contacts in the adjacent strips, namely, in the vertical direction as viewed in FIG. 4.

Figure 11:
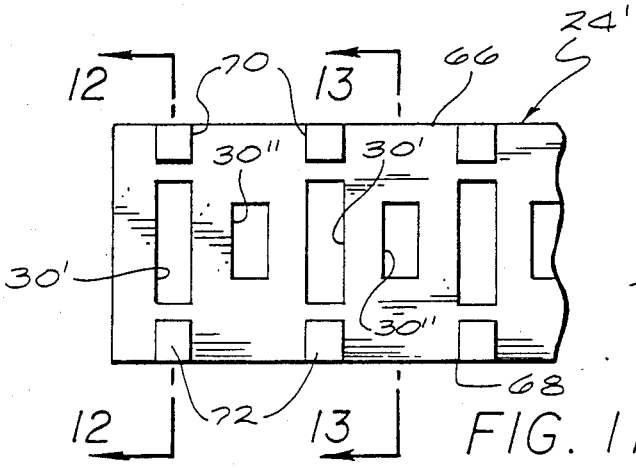
FIG. 11 is an enlarged, fragmentary side view of the opposite side of one end of the strip illustrated in FIG. 9.
Figure 12:
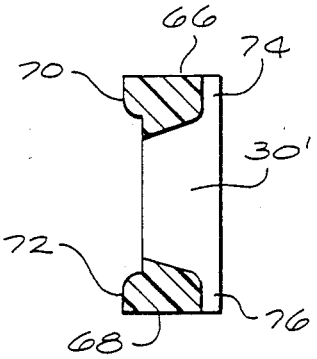
FIG. 12 is a vertical sectional view taken along line 12—12 of FIG. 11.
Figure 13:
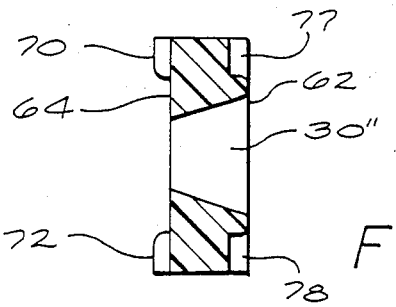
FIG. 13 is a vertical sectional view taken along line 13—13 of FIG. 11.

The strips 24′ of the connector insulator assembly 60 are identical. One of such strips is shown in detail in FIGS. 9–3. The strip has opposite, generally vertically extending sides 62 and 64, an upper surface 66 and an opposite lower surface 68. A series of equally spaced vertically extending tongues 70 are formed on the side 64 of the strip adjacent to the upper surface 66 of the strip. A second series of tongues 72 are formed on the side 64 of the strip adjacent to the lower surface 68 thereof, and aligned with the tongues 70, as best seen in FIG. 11. Tongues 70 and 72 are aligned with the cavities 30′ in the strip. Vertically extending slots 74 and 76 in the side 62 of the strip communicate with each cavity 30′, and open at the upper surface 66 and lower surface 68 of the strip, respectively. Such slots correspond to the holes 38 in the strips illustrated in FIGS. 1–3, and receive ends 34*a*′ and 34*b*′ of the contacts.

Each strip 24' is formed with alternate relatively large cavities 30' and alternate relatively smaller cavities 30'' positioned between the larger cavities along the length of the strip. Vertically extending grooves 77 and 78 are formed in the side 62 of the strip opening to the upper surface 66 and lower surface 68 of the strip, respectively, and aligned with the cavities 30''. The grooves 77 and 78 are dimensioned to slidably receive the matching tongues 70 and 72 on the next adjacent strip when the strips are mounted in side-by-side relationship, with one strip offset lengthwise one cavity length with respect to the other strip, that is, a distance corresponding to the distance between adjacent cavities 30' and 30''.

It is noted that the upper and lower walls of the cavities 30' and 30' are tapered. The angle of taper of the walls of the two cavities generally match each other so that when the cavities are aligned, as seen in FIG. 5, they form a recess having a taper generally complementary to the angle of the legs 50' of the contact and a length which accommodates the middle portion of the contact. Thus, as in the first embodiment of the invention, the middle portion of each contact occupies two cavities formed in adjacent strips, so that the length of the middle portion of the contact can be maximized to increase the flexibility of the contact. In the connector shown in FIG. 5, the middle portion of each contact could even extend into a third cavity, namely, a larger cavity 30'', of a third conductive strip of the connector. The taper on the walls of the contact cavities, and particularly of the small cavity 30'', is provided to closely confine the apex end of the middle portion of the contact to assure separation between adjacent contacts in a series of cavities in the connector. Further, by making the cross-section of the cavities 30'' in each strip relatively small, the width of the strip above and below such cavities is relatively larger, which allows the use of a larger pathway in the mold which is used to form the strip that facilitates the flow of plastic through the mold during the molding process.

As stated previously, the strips 24' are mounted such that each adjacent strip is offset lengthwise relative to the next strip, as seen in FIG. 5, whereby the tongues 70 and 72 on the side 64 of one strip will engage aligned grooves 77 and 78, respectively, in the facing side 62 of the next adjacent strip. This results in the contact cavities 30' being staggered relative to each other, so that the ends of the contacts will be in a staggered array as illustrated in FIG. 4. By this arrangement, the middle portions of the contacts mounted in the cavities 30' in each strip can extend into the smaller cavities 30'' in the next adjacent strip. The tongue and groove arrangement on the strips interlocks the strips together to allow a precise spacial alignment of the contacts. Further, by the staggered arrangement of the contacts in the insulator assembly 60, the strips 24' may be made relatively thin, which permits miniaturization of the connector, yet the matching contact cavities 30', 33' in adjacent strips form enlarged flex chambers for the relatively long V-shaped middle portions of the contacts. The inter-engaging tongues and grooves on the adjacent strips 24' of the connector not only precisely position and hold the strips lengthwise relative to each other, but also interlock the strips vertically relative to each other, as viewed in FIG. 6, so that the upper and lower surfaces of the strips, respectively, will be coplaner.

The frame 52 of the connector assembly 54 is formed of a relatively rigid material, such as aluminum, and embodies two sides 80 and a bottom 82, forming a rectangular recess 84 in which the connector 20' is mounted. The fourth side of the retangular frame 52 is formed by a pressure plate or clamp 86 which is secured to the sides of the frame by a pair of screws 88. Preferably the insulative strips of the connector are formed of a thermoplastic which is slightly pliable, and thus capable of some compression. The vertical dimensions of the connector, as viewed in FIG. 4, is slightly greater than the vertical dimensions of the recess 84 in the frame, so that when the clamp 86 is mounted over the connector onto the sides 80 of the frame, the plastic strips will be slightly compressed, thereby accommodating for any manufacturing tolerance build-up in the plastic strips, and achieving a precise vertical dimension of the insulator assembly 60 thereby equalizing the contact spacing porportionately throughout the assembly.

Figure 6:
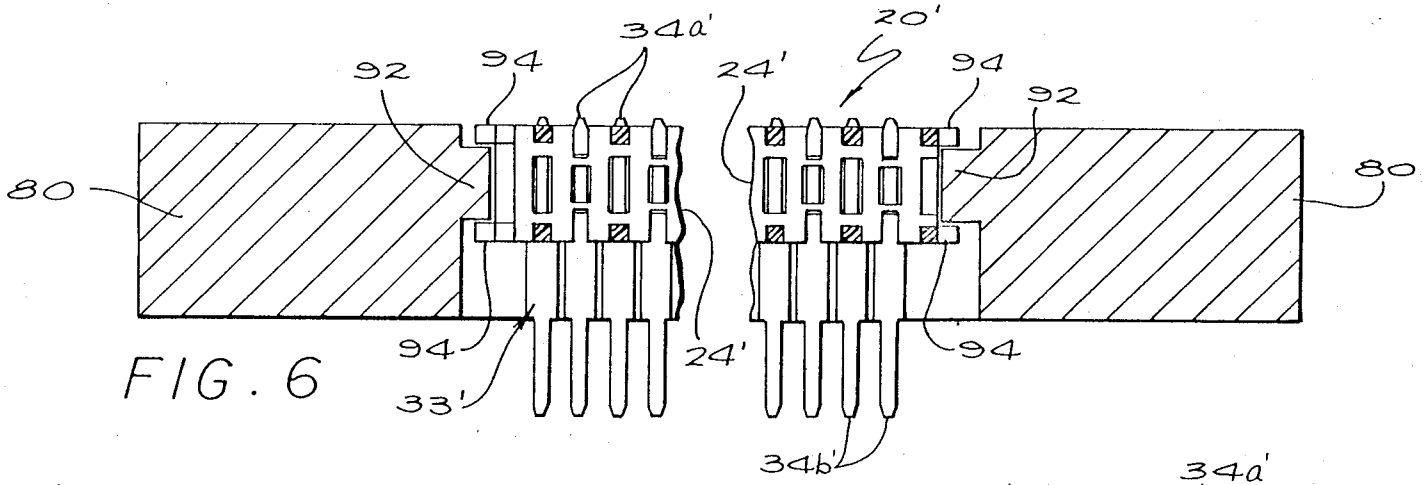
FIG. 6 is a sectional view taken along line 6—6 of FIG. 4.

To precisely and firmly hold the assembly of strips of the connector in the recess 84 of the connector mounting frame 52, a rib 90 is formed on the bottom 82 of the frame which engages between the tongues 70 and 72 of the lower strip 24' in the assembly, as best seen in FIG. 5, and ribs 92 are formed on the sides 80 of the frame which extend between spaced projections 94 on one end of each strip 24', as best seen in FIGS. 4 and 6. The strips are mounted reverse relative to each other so that only one end of the strip needs to be formed with the projections 94.

It should be noted that the lower strip 24' of the connector 20' has no contacts mounted in the large cavities 30' therein since doing so would interfere with the mounting of the lower strip on the rib 90 of the frame. Further, the upper strip of the assembly illustrated in FIGS. 4 and 5 contains no contacts so that it may be used as an intermediate pressure member, and avoid any force being applied by the clamp 86 directly against any contacts in the assembly.

It is noted that the connector as illustrated in FIG. 4 contains ten rows of contacts, with ten contacts in each row, thus providing a staggered array of 100 contacts. By way of example only, a connector has been built as illustrated in FIGS. 4–13, containing 100 contacts, with the contact ends 35' spaced from each other 28 mils. The size of the connector 20' (namely, the insulator assembly 60) was 0.240 inch by 0.410 inch. By increasing the number of insulative strips used in the connector, and the length of the strips, the number of contacts can be increased to thousands.

As will be apparent, by the present invention miniaturization of a high density connector can be achieved. For example, a connector having a thousand contacts could be mounted in an insulator assembly having dimensions of about one inch by two inches.

Although several embodments of the invention have been disclosed herein for purposes of illustration, it will be understood that various changes can be made in the form, details, arrangement and proportions of the various parts in such embodiments without departing from the spirit and scope of the invention as defined by the appended claims.

What is claimed is:

1. An electrical connector comprising:

a stack of insulators;

said stack having opposite surfaces;

a series of aligned cavities in said insulators extending lengthwise through said stack;

contacts mounted in selected ones of said cavities; and said contact in each said selected cavity having ends extending beyond said surfaces, and a middle spring portion extending from said selected cavity into the next adjacent cavity in said series whereby said middle portion occupies two cavities.

2. An electrical connector as set forth in claim 1 wherein:

said middle portion of each said contact is generally V-shaped, with the apex of said V being located in said next adjacent cavity.

3. An electrical connector as set forth in claim 1 wherein:

a plurality of said series of aligned cavities extend transversely through said stack, each said series including said selected cavities.

4. An electrical connector as set forth in claim 1 wherein:

said selected cavities are alternative cavities in said series.

5. An electrical connector as set forth in claim 1 wherein:

a plurality of said series of aligned cavities extend transversely through said stack;

said selected cavities are alternate cavities in each of said series, and are staggered relative to the selected cavities in the next adjacent series of said cavities whereby said ends of said contacts in said selected cavities are arranged in adjacent rows staggered relative to each other.

6. An electrical connector as set forth in claim 5 wherein:

said insulators are elongated strips mounted in side-by-side relationship; and said plurality of said series of cavities in said stack are formed by rows of cavities in said strips, alternate cavities in said rows being said selected cavities.

7. An electrical connector as set forth in claim 6 wherein:

said strips are identical and each strip is offset lengthwise relative to each adjacent strip such that the selected cavities in alternate strips are aligned with each other.

8. An electrical connector comprising:

a plurality of insulative strips mounted in side-by-side relationship providing an insulator assembly having upper and lower surfaces;

each said strip having a row of contact cavities therein, each said cavity in each strip communicating with a corresponding cavity in the next adjacent strip;

a pair of holes in each of said strips associated with selected ones of said cavities therein, said holes of each said pair communicating with their corresponding cavity and opening at said upper and lower surfaces;

a contact mounted in some of said selected cavities having opposite ends extending through said holes; and each said contact having a resilient middle portion shaped to form an acute angle, said middle portion being disposed in two of said cavities in adjacent strips.

9. An electrical connector as set forth in claim 8 wherein:

said selected cavities in each said strip are staggered relative to the selected cavities in each next adjacent strip whereby the contacts therein are staggered relative to each other.

10. An electrical connector as set forth in claim 8 wherein:

said selected cavities are alternate cavities in each said strip; and said middle portion of each said contact in one said strip has an apex end extending into a cavity located between said selected cavities in the next adjacent strip.

11. An electrical connector as set forth in claim 8 in combination with a board having a plurality of conductors thereon arranged in a pattern corresponding to the pattern of the contact ends projecting outwardly through said holes associated with said selected cavities in said strips;

when said board is pressed toward said insulator assembly over said projecting contact ends, said ends are moved inwardly into said holes causing said middle portions of said contacts to resiliently deflect thereby producing a spring force between said contact ends and said conductors on said board.

12. An electrical connector as set forth in claim 8 including:

a generally rectangular frame surrounding said insulator assembly;

said frame having one side separable from the remainder of said frame;

means for mounting said one side onto said remainder of said frame; and said one side of said frame running lengthwise along the side of one of said strips of said insulator assembly and functioning as a pressure plate to compress said assembly of strips upon mounting of said one side onto said remainder of said frame.

13. An electrical connector as set forth in claim 8 including:

interlocking means on said strips for precisely mounting said strips relative to each other.

14. An electrical connector as set forth in claim 13 wherein:

said interlocking means comprises cooperating tongue and groove means on said strips.

15. An electrical connector as set forth in claim 13 wherein:

said interlocking means comprises a plurality of tongues on one side of each said strip and a plurality of corresponding grooves on the opposite side of each said strip, said selected cavities in each said strip opening to one side of said strip and being disposed alternately relative to said tongues or grooves on said side.

16. An electrical connector as set forth in claim 15 wherein:

said strips are identical; and each said strip is offset lengthwise relative to the next adjacent strip so that the tongues on one strip engage in the grooves of the next adjacent strip and said said cavities in said strips are staggered relative to each other.

17. An electrical connector as set forth in claim 16 wherein:

said holes are provided by slots formed in the sides of said strips.

* * * * *